US008987621B2

(12) United States Patent
Inoue

(10) Patent No.: US 8,987,621 B2
(45) Date of Patent: Mar. 24, 2015

(54) PRESS OPERATION DEVICE

(71) Applicant: Sumitomo Wiring Systems, Ltd., Mie (JP)

(72) Inventor: Masatomo Inoue, Mie (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 211 days.

(21) Appl. No.: 13/803,800

(22) Filed: Mar. 14, 2013

(65) Prior Publication Data

US 2013/0313092 A1 Nov. 28, 2013

(30) Foreign Application Priority Data

May 28, 2012 (JP) ..... 2012-120414

(51) Int. Cl.
*H01H 3/12* (2006.01)
*H01H 13/14* (2006.01)

(52) U.S. Cl.
CPC ..... *H01H 3/12* (2013.01)
USPC ..... 200/341

(58) Field of Classification Search
CPC ..... H01H 13/14; H01H 13/70; H01H 3/12; H01H 1/64; H01H 1/66; H01H 9/02; H01H 9/06; H01H 13/00; H01H 19/04; H01H 19/08; H01H 21/00
USPC ..... 200/341, 5 A, 5 R, 293, 302.2, 318.1, 200/329, 333, 344, 345
See application file for complete search history.

(56) References Cited

U.S. PATENT DOCUMENTS 5,144,103 A * 9/1992 Suwa ..... 200/344
5,247,143 A * 9/1993 Suwa ..... 200/517
5,448,026 A * 9/1995 Ozeki et al. ..... 200/5 A
5,817,997 A * 10/1998 Wernig ..... 200/16 R

FOREIGN PATENT DOCUMENTS

JP 2011-009132 1/2011

* cited by examiner

*Primary Examiner* — Edwin A. Leon
*Assistant Examiner* — Anthony R. Jimenez
(74) *Attorney, Agent, or Firm* — Greenblum & Bernstein, P.L.C.

(57) ABSTRACT

A first operation member includes a first sidewall and a first engaged part. A second operation member includes a second sidewall and a second engaged part. A holding member includes a holding member main body, a first engagement part, a second engagement part, an elastically deformable part, a first limiting part, and a second limiting part. The elastically deformable part elastically deforms in a manner that the first engagement part is displaced in a direction away from the first limiting part until insertion of the first engaged part into between the first engagement part and the first limiting part is allowed, and elastically deforms in a manner that the second engagement part is displaced in a direction away from the second limiting part until insertion of the second engaged part into between the second engagement part and the second limiting part is allowed.

4 Claims, 10 Drawing Sheets

PRESS OPERATION DEVICE

CROSS-REFERENCE TO RELATED APPLICATIONS

The present application claims priority under 35 U.S.C. §119 of Japanese Application No. 2012-120414, filed on May 28, 2012, the disclosure of which is expressly incorporated by reference herein in its entirety.

BACKGROUND OF THE INVENTION

1. Field of the Invention

The present invention relates to a press operation device used in an electronic equipment provided in a vehicle and the like.

2. Description of Related Art

Conventionally, as an operation device installed in various electronic equipments, a press operation device is known. For example, in a case of being installed in a vehicle such as a car, such a press operation device is used for operating an electronic equipment of the vehicle such as an air conditioner, a car navigation system, or a car audio system.

An example of such a press operation device is disclosed in the following Patent Document 1. This press operation device is provided with a plurality of operation members 110 (FIG. 9) and a holding member 130 (FIG. 10) holding the operation members 110. As illustrated in FIG. 9, the operation member 110 includes an operated part 111 that is press-operated, sidewalls 112 formed on a back side of the operated part 111, and engaged parts 113 that are engaged by the holding member 130. As illustrated in FIG. 10, the holding member 130 includes a plurality of holding parts 132 divided from each other by a partition wall 131. The holding parts 132 each have a shape capable of respectively holding each of the operation members 110. Further, each of the holding parts 132 includes a first insertion hole 133 and a second insertion hole 134 allowing the engaged parts 113 of the operation member 110 to be respectively inserted thereinto. The engaged parts 113 are respectively inserted into the insertion holes 133, 134 and become in contact with a back side of the holding member 130. Thereby, the operation member 110 is held by the holding part 132.

Patent Document 1: Japanese Patent Laid-Open Publication No. 2011-009132

In the press operation device described in Patent Document 1, in order to allow insertion of the engaged parts 113, a dimension of each of the insertion holes 133, 134 in an aligned direction (left-right direction in FIG. 10) of the insertion holes must be configured to be larger than a thickness dimension that is a sum of a dimension of the sidewall 112 in the aligned direction and a dimension of the engaged part 113 in the aligned direction. This can lead to problems, for example, such as the following.

(1) In a case such as when an impact is applied to the press operation device, the engaged parts 113 of the plurality of the operation members 110 may slip out from respective insertion holes 133, 134. Therefore, there is a possibility that the operation members 110 may simultaneously drop out from the holding member 130.

(2) The holding member 130 is prevented from being reduced in size in the aligned direction, which prevents the operation member 110 from being reduced in size in the same direction. Specifically, there is a case where a light source for illuminating the operated part 111 of the operation member 110 is provided on a printed circuit board arranged on the back side of the holding member 130. In this case, in order to secure an illumination range of the light source, it is necessary that a dimension between the first insertion hole 133 and the second insertion hole 134 of the holding part 132 in the aligned direction be equal to or larger than a predetermined dimension. As described above, the dimension of each of the insertion holes 133, 134 in the aligned direction is configured to be larger than the thickness dimension. Therefore, it is unavoidable that the holding parts 132 each become large in the aligned direction and thus it is also unavoidable that the operation members 110 each become large in the aligned direction. \

SUMMARY OF THE INVENTION

The present invention is made to solve the above described problem. A purpose of the present invention is to provide a press operation device capable of shortening a dimension of a portion of a holding member that allows an engaged part of an operation member to be inserted therethrough.

To solve the above-described problems, the present invention provides a press operation device, which includes a first operation member having a first operated part that is press-operated; a second operation member adjacent to the first operation member and having a second operated part that is press-operated in a direction same as a pressing direction of the first operation member; and a holding member holding the first operation member and the second operation member. The first operation member includes a first sidewall having a shape that extends from a back surface of the first operated part along the pressing direction; and a first engaged part protruding from a fore end part of the first sidewall toward a second operation member side to be engaged by the holding member. The second operation member includes a second sidewall having a shape that extends from a back surface of the second operated part along the pressing direction; and a second engaged part protruding from a fore end part of the second sidewall toward a first operation member side to be engaged by the holding member. The holding member includes a holding member main body having an inner peripheral surface of a shape that allows insertion of the first sidewall and the second sidewall along a direction same as the pressing direction and surrounds together the first operation member and the second operation member; a partition wall interposed between the first sidewall and the second sidewall and dividing the first operation member and the second operation member; a first limiting part limiting displacement of the first sidewall in a direction away from the partition wall; and a second limiting part limiting displacement of the second sidewall in a direction away from the partition wall. The partition wall includes a movable part capable of relative displacement with respect to the inner peripheral surface of the holding member main body in an aligned direction of the first sidewall and the second sidewall. The movable part includes a first engagement part engaging the first engaged part so as to restrict displacement of the first engaged part in a direction opposite to an insertion direction of the first operation member by becoming in contact with the first engaged part from an upstream side in the insertion direction; a second engagement part engaging the second engaged part so as to restrict displacement of the second engaged part in the direction opposite to the insertion direction by becoming in contact with the second engaged part from the upstream side in the insertion direction; and an elastically deformable part that elastically deforms so as to allow the first engagement part and the second engagement part to be displaced in the aligned direction. The first limiting part has a shape such that a dimension between the first engagement part and the first limiting part in a state in which the elastically deformable part is not elastically deformed is smaller than a first thickness dimension that is a sum of a dimension of the first sidewall in the aligned direction and a dimension of the first engaged part in the aligned direction. The second limiting part has a shape such that a dimension between the second engagement part and the second limiting part in the state in which the elastically deformable part is not elastically deformed is smaller than a second thickness dimension that is a sum of a dimension of the second sidewall in the aligned direction and a dimension of the second engaged part in the aligned direction. When the first engagement part receives an external force in a direction away from the first limiting part, the elastically deformable part elastically deforms in such a manner that the first engagement part is displaced in the direction away from the first limiting part until a dimension between the first engagement part and the first limiting part is larger than the first thickness dimension and insertion of the first engaged part into between the first engagement part and the first limiting part is allowed. When the second engagement part receives an external force in a direction away from the second limiting part, the elastically deformable part elastically deforms in such a manner that the second engagement part is displaced in the direction away from the second limiting part until a dimension between the second engagement part and the second limiting part is larger than the second thickness dimension and insertion of the second engaged part into between the second engagement part and the second limiting part is allowed.

In the press operation device of the present embodiment, the dimension between the first engagement part and the first limiting part in the state in which the elastically deformable part is not elastically deformed is smaller than the first thickness dimension (sum of the dimension of the first sidewall in the aligned direction and the dimension of the first engaged part in the aligned direction). The dimension between the second engagement part and the second limiting part in the state in which the elastically deformable part is not elastically deformed is smaller than the second thickness dimension (sum of the dimension of the second sidewall in the aligned direction and the dimension of the second engaged part in the aligned direction). Further, the elastically deformable part is provided in the partition wall. When the first engagement part receives an external force in the direction away from the first limiting part, the elastically deformable part elastically deforms in such a manner that the first engagement part is displaced in the direction away from the first limiting part until the dimension between the first engagement part and the first limiting part is larger than the first thickness dimension and insertion of the first engaged part into between the first engagement part and the first limiting part is allowed. When the second engagement part receives an external force in the direction away from the second limiting part, the elastically deformable part elastically deforms in such a manner that the second engagement part is displaced in the direction away from second limiting part until the dimension between the second engagement part and the second limiting part is larger than the second thickness dimension and the insertion of the second engaged part into between the second engagement part and the second limiting part is allowed. Therefore, while allowing the operation members to be installed to the holding member, the dimensions of the portions of the holding member into which the engaged parts of the operation members are inserted can be shortened.

This allows, for example, the first operation member and the second operation member to be prevented from simultaneously slipping out. Further, in the case where the light sources for illuminating the operated parts are provided, it is possible to reduce the dimensions of the holding member and the operation members in the aligned direction while securing illumination ranges of the light sources.

Specifically, the sum of the dimension between the first engagement part and the first limiting part in the state in which the elastically deformable part is not elastically deformed and the dimension between the second engagement part and the second limiting part in the state in which the elastically deformable part is not elastically deformed is smaller than the sum of the first thickness dimension and the second thickness dimension. Therefore, after the two engaged parts are engaged by the engagement parts, even when an impact or the like is applied t the press operation device, the operation members can be prevented from simultaneously dropping out from the holding member.

Further, the dimension between the first engagement part and the first limiting part in the state in which the elastically deformable part is not elastically deformed is shortened. Therefore, for example, in the case where the light source for illuminating the first operation member is provided, it is possible to shorten a dimension between the light source and the partition wall while securing an illumination range of the light source. This allows the dimension of the first operation member in the aligned direction to be reduced. The same applied to the second operation member side.

Further, in the present invention, the partition wall includes a fixed part fixed on the holding member main body by being connected to the inner peripheral surface of the holding member main body; and the movable part. The movable part has a shape that extends from the fixed part along the insertion direction and is spaced apart from the inner peripheral surface. The elastically deformable part elastically deforms in such a manner that the first engagement part and the second engagement part are displaced in the aligned direction.

In this way, the movable part is held by the fixed part. Therefore, the position of the movable part in the area surrounded by the inner peripheral surface of the holding member main body is stable. Further, the movable part containing the elastically deformable part is not restricted by the inner peripheral surface. Therefore, the elastically deformable part can easily deform.

In this case, it is desirable that the first sidewall include a first deformable part that elastically deforms in a manner allowing the first engaged part to be displaced in a direction approaching the first limiting part when the first engaged part receives an external force in the direction approaching the first limiting part, that the second sidewall include a second deformable part that elastically deforms in a manner allowing the second engaged part to be displaced in a direction approaching the second limiting part when the second engaged part receives an external force in the direction approaching the second limiting part, that the first limiting part be formed at a position that allows the first engaged part to be displaced in the direction approaching the first limiting part, and that the second limiting part be formed at a position that allows the second engaged part to be displaced in the direction approaching the second limiting part.

In this way, when the first engaged part engages with the first engagement part, the first engagement part can be displaced in the direction away from the first limiting part and the first engaged part can be displaced in the direction approaching the first limiting part. Therefore, the first operation member can be smoothly installed. Similarly, when the second engaged part engages with the second engagement part, the second engagement part can be displaced in the direction away from the second limiting part and the second engaged part can be displaced in the direction approaching the second limiting part. Therefore, the second operation member can be smoothly installed.

As described above, according to the present invention, a press operation device can be provided in which a dimension in an aligned direction of operation members in a holding member can be shortened.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

A preferred embodiment of the present invention is explained with reference to FIGS. 1-8. In each of the drawings, an end part of a first operation member 10 (to be described later) on a side opposite to a second operation member 20 side is omitted. Further, in the following explanation, an operated parts 11, 21 (to be described later) side (upper side in FIG. 3) is a surface side or a front end side, and an opposite side (lower side in FIG. 3) of that side is a back side or a rear end side.

Figure 1:
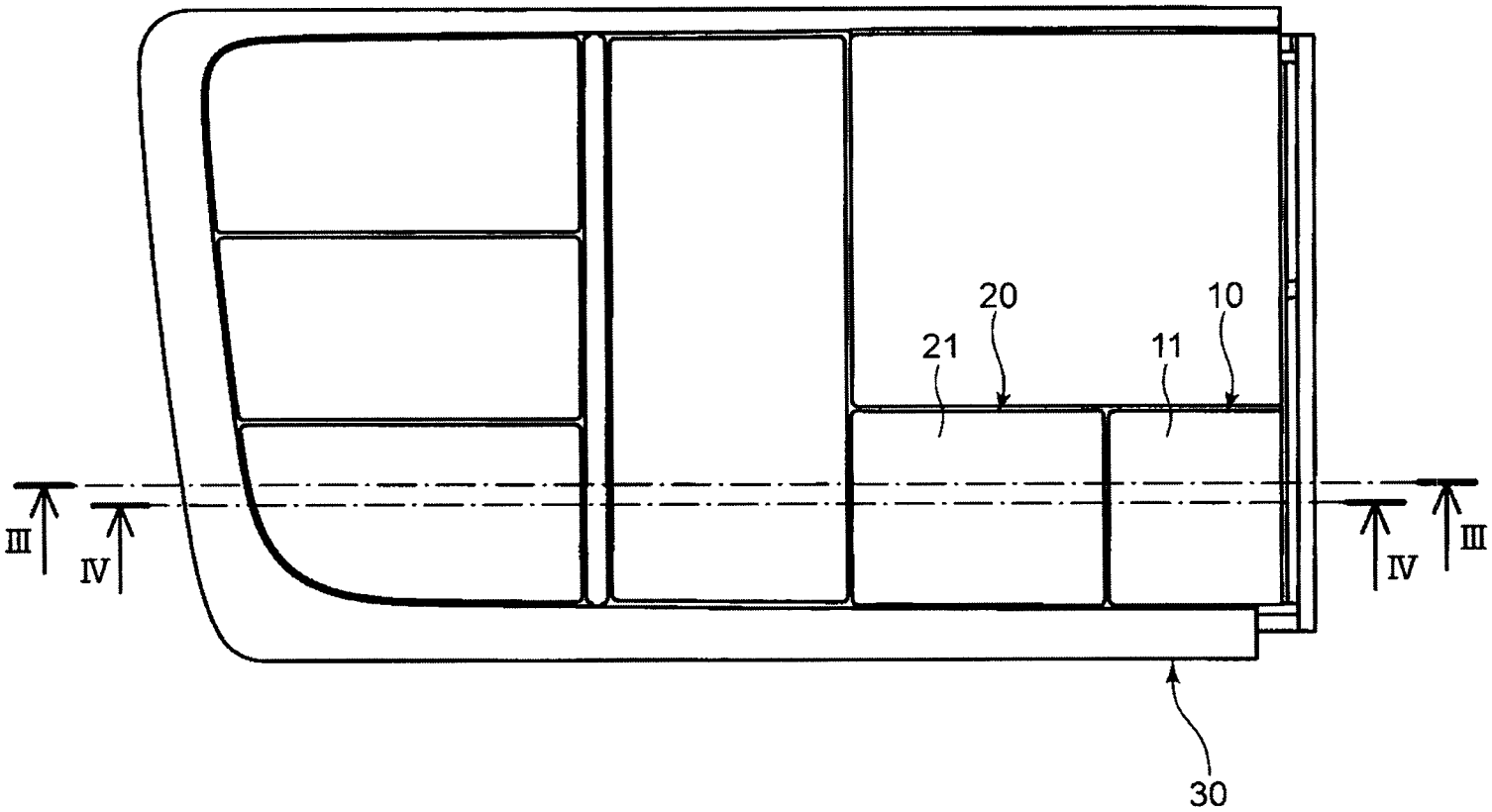
FIG. 1 is a plan view of a press operation device according to an embodiment of the present invention.
Figure 2:
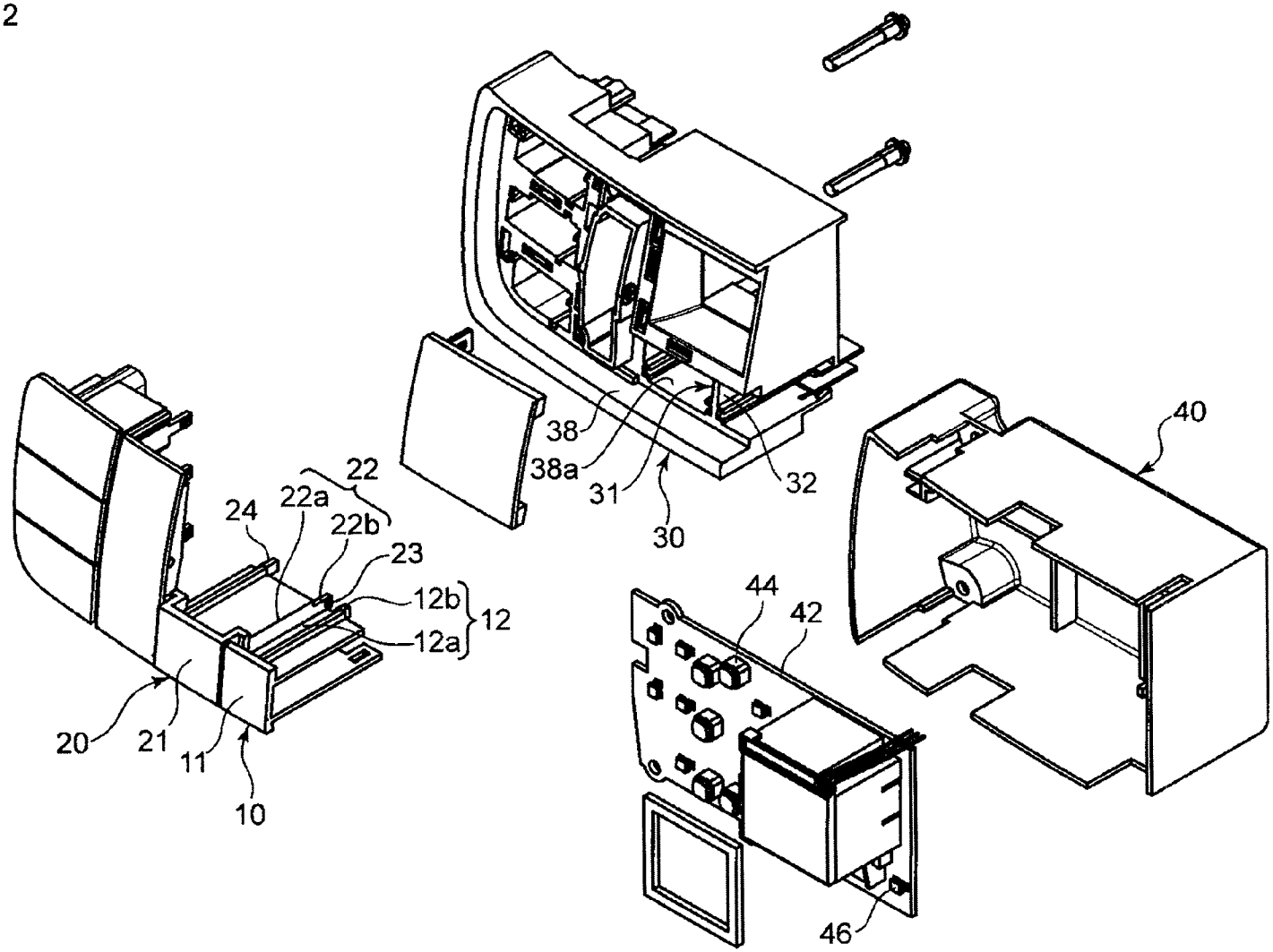
FIG. 2 is an exploded perspective view of the press operation device illustrated in FIG. 1.
Figure 3:
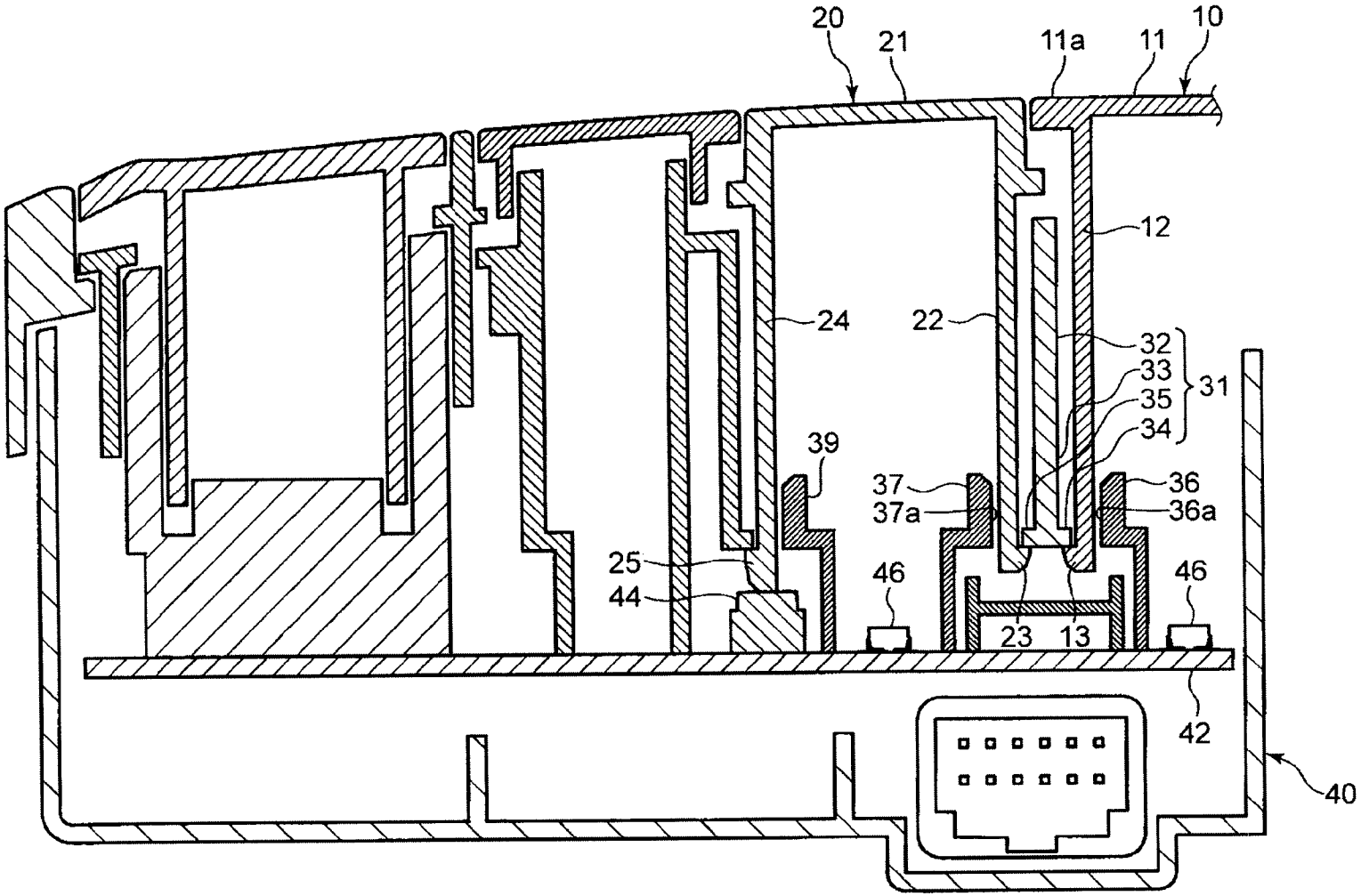
FIG. 3 is a cross-sectional view along a line in FIG. 1.

As illustrated in FIGS. 1-3, a press operation device according to the present embodiment is provided with a first operation member 10 that is press-operated in a particular direction (downward direction in FIG. 3), a second operation member 20 that is adjacent to the first operation member 10 and is press-operated in the same direction as the pressing direction of the first operation member 10, and a holding member 30 holding the first operation member 10 and the second operation member 20. The press operation device is housed in a case 40. The case 40 houses a printed circuit board 42 on a more rear end side than the press operation device. A detection element 44 detecting a press operation of each operation member and light sources 46 for illuminating the operation members are mounted on the printed circuit board 42.

The first operation member 10 has a first operated part 11 that is press-operated, a first sidewall 12 that has a shape extending from a back surface of the first operated part 11 along the pressing direction, and a first engaged part 13 that is connected to a fore end part of the first sidewall 12 and is engaged by the holding member 30. The first operation member 10 is inserted into the holding member 30 along a direction same as the pressing direction, thereby being held by the holding member 30.

The first operated part 11 has a substantially rectangular shape. The first sidewall 12 is connected to the back surface of the first operated part 11 at a site near the second operation member 20. Further, the first operated part 11 has a protruding part 11*a* of a shape protruding toward the second operation member 20 side from the site at which the first sidewall 12 is connected. The protruding part 11*a* is formed in a shape covering a front end side of a partition wall 31 (to be described later).

Figure 6:
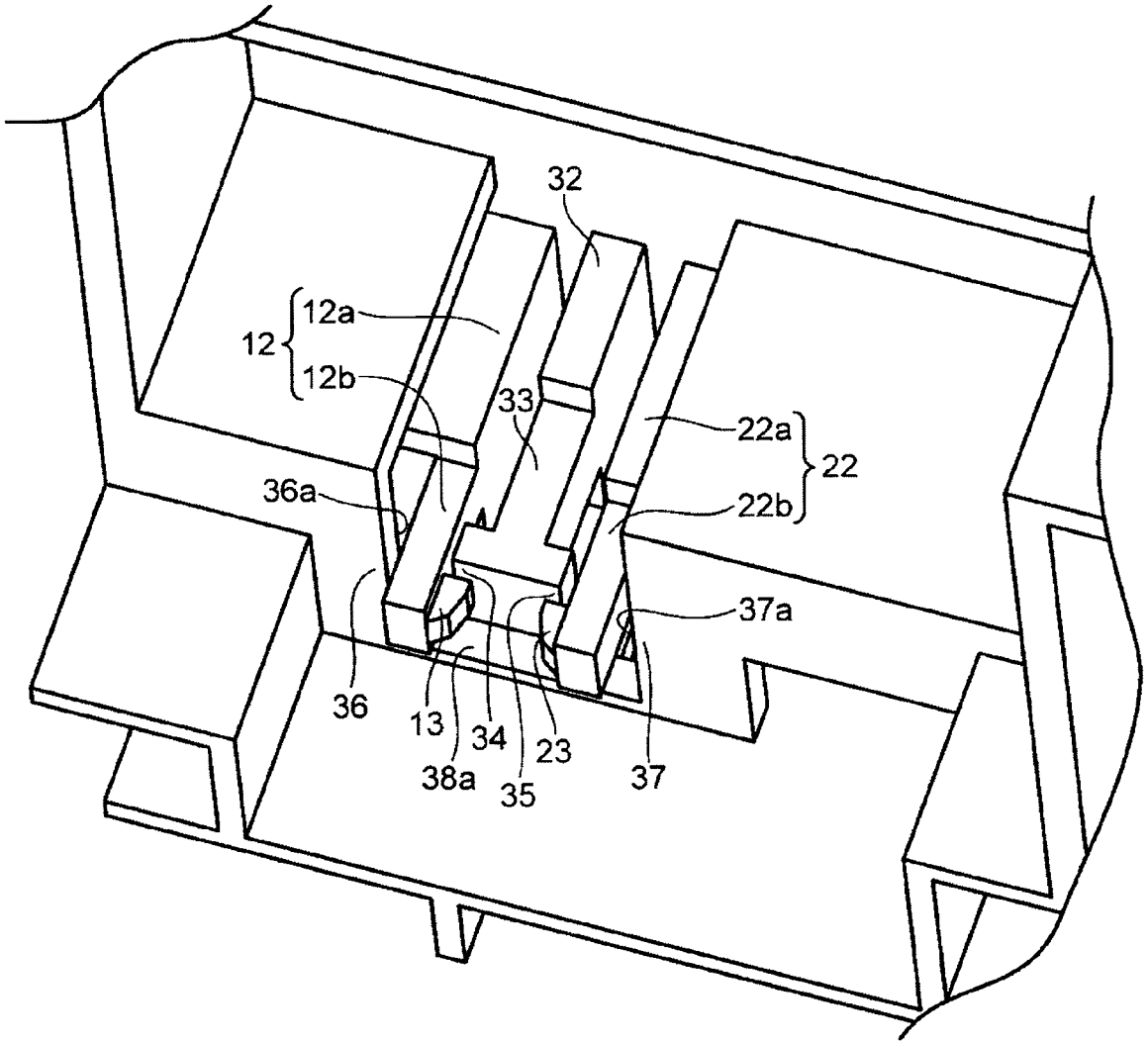
FIG. 6 is a perspective view of a state in which a portion of a holding member illustrated in FIG. 5 is omitted.
Figure 7:
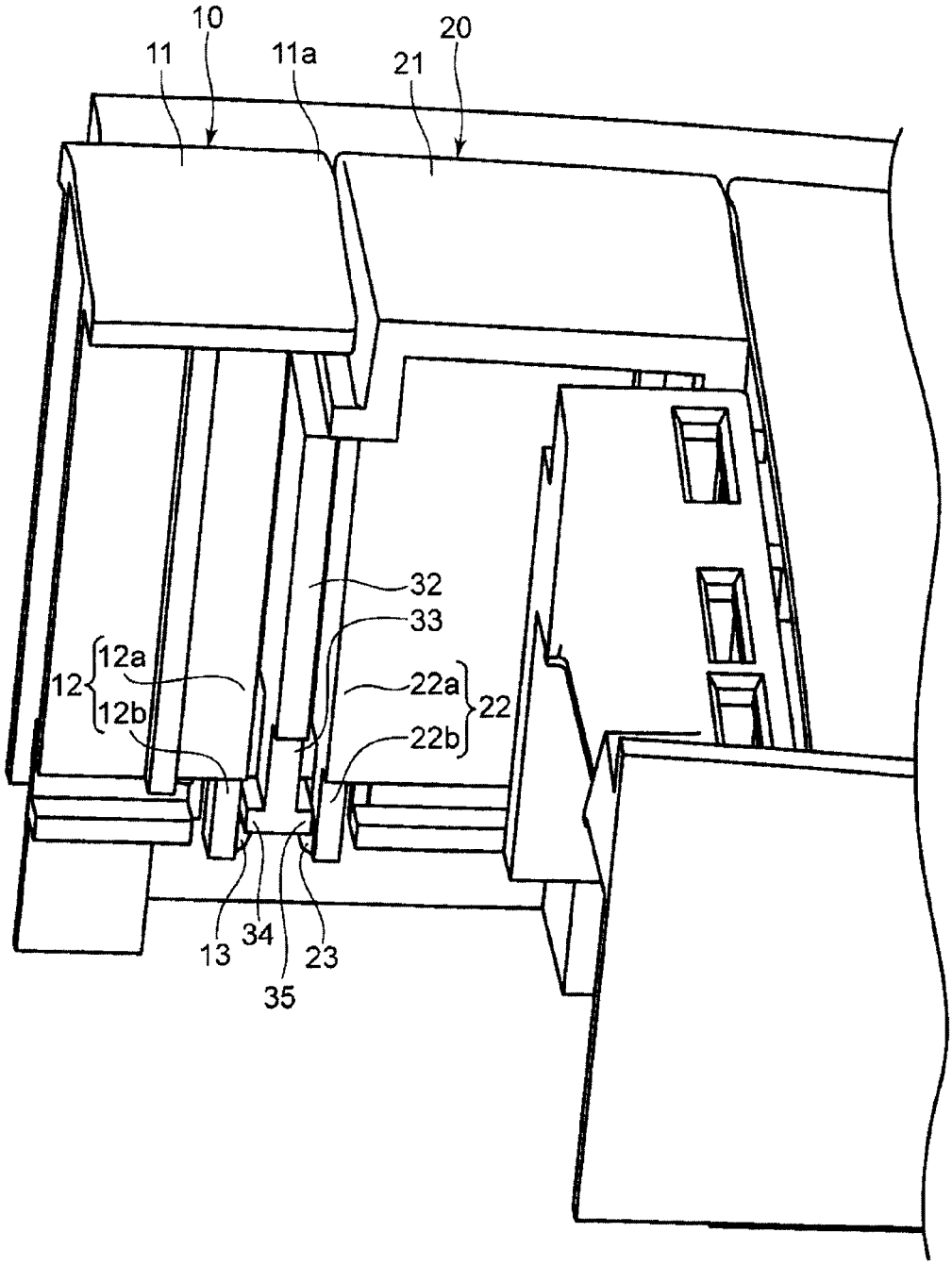
FIG. 7 is a perspective view of a state viewed from a different angle in which a portion of the holding member illustrated in FIG. 5 is omitted.

The first sidewall 12 has a shape that is long in one direction (up-down direction in FIG. 3). The first sidewall 12 is formed in such a manner that a thickness dimension of the first sidewall 12 in an aligned direction (left-right direction in FIG. 3) of the operation members is uniform over the entire area of the first sidewall 12 along a longitudinal direction. As illustrated in FIGS. 6 and 7 and the like, the first sidewall 12 has a first sidewall main body 12*a* that has a shape extending from the back surface of the first operated part 11 along the pressing direction, and a first deformable part 12*b* that has a shape extending from a rear end surface of the first sidewall main body 12*a* along the pressing direction. In FIGS. 6 and 7, a portion of the holding member 30 in a front side of the paper is omitted. The first sidewall main body 12*a* has a predetermined dimension in a third direction that is orthogonal to the aligned direction (first direction) of the operation members and the longitudinal direction (second direction) of the first sidewall 12. The first deformable part 12*b* has a dimension in the third direction smaller than the dimension of the first sidewall main body 12*a* in the same direction (the third direction being orthogonal to the first direction and the second direction), and has a shape that extends from substantially a central portion, in the third direction, of a rear end surface of the first sidewall main body 12*a* toward the rear end side. The first deformable part 12*b* is capable of deflective deformation using a boundary with the first sidewall main body 12*a* as a fulcrum point in a manner allowing a rear end part of the first deformable part 12*b* to be displaced in a direction away from the second operation member 20 (direction approaching a first limiting part 36 (to be described later)).

As illustrated in FIG. 6 and the like, the first engaged part 13 has a shape protruding from the rear end part of the first deformable part 12*b* toward the second operation member 20 side. Specifically, the first engaged part 13 has a shape in which its amount of protrusion from the first deformable part 12*b* becomes smaller from its front end toward its rear end. Further, a front end surface (end surface on an upstream side in the pressing direction) of the first engaged part 13 is formed flat. By applying an external force to the first engaged part 13 in a direction opposite to the protruding direction from the first deformable part 12*b*, the first deformable part 12*b* deflectively deforms to allow the first engaged part 13 to move away from the partition wall 31 (to approach the first limiting part 36).

The second operation member 20 has a shape similar to the first operation member 10. The second operation member 20 has a second operated part 21 that is press-operated, a second sidewall 22 that is formed on a back surface of the second operated part 21, a second engaged part 23 that is connected to a rear end part of the second sidewall 22 and is engaged by the holding member 30, a third sidewall 24 that is formed on the back side of the second operated part 21, and a third engaged part 25 that is connected to a rear end part of the third sidewall 24 and is engaged by the holding member 30. The third sidewall 24 and the third engaged part 25 have the same shapes as that of the second sidewall 22 and the second engaged part 23, and thus, their explanation is omitted. The second operation member 20 is also inserted into the holding member 30 along a direction same as the pressing direction, thereby being held by the holding member 30.

The first operated part 21 has a substantially rectangular shape. The second sidewall 22 has a shape that extends along the pressing direction from a site near the first operation member 10 on the back surface of the second operated part 21. The second sidewall 22 has a shape that is symmetric to that of the first sidewall 12 with respect to the partition wall 31, and the second engaged part 23 has a shape that is symmetric to that of the first engaged part 13 with respect to the partition wall 31, and thus, their explanation is omitted.

The holding member 30 has a holding member main body 38, the partition wall 31 that is interposed between the first operation member 10 and the second operation member 20 dividing between these operation members, the first limiting part 36 limiting the displacement of the rear end part of the first sidewall 12, a second limiting part 37 limiting the displacement of the rear end part of the second sidewall 22, and a third limiting part 39 limiting the displacement of the third sidewall 24.

As illustrated in FIG. 2, the holding member main body 38 has an inner peripheral surface 38*a*, which has shape that allows insertion of the first sidewall 12 and the second sidewall 22 along a direction same as the pressing direction and surrounds together the first operation member 10 and the second operation member 20.

The partition wall 31 partitions the area surrounded by the inner peripheral surface 38*a* into an area where the first operation member 10 is inserted and an area where the second operation member 20 is inserted. Specifically, the partition wall 31 is provided between the first sidewall 12 and the second sidewall 22 and has a shape that is long in a direction same as the longitudinal direction of the sidewalls 12, 22. The partition wall 31 has a fixed part 32 fixed on the holding member main body 38, and a movable part capable of relative displacement with respect to the inner peripheral surface 38*a* in the aligned direction (first direction) of the first sidewall 12 and the second sidewall 22. The movable part has a shape that extends from a rear end surface of the fixed part 32 along a direction same as the insertion direction of the operation members 10, 20. The movable part has an elastically deformable part 33 capable of elastic deformation, a first engagement part 34 engaging the first engaged part 13, and a second engagement part 35 engaging the second engaged part 23.

As illustrated in FIG. 2, the fixed part 32 is fixed to the holding member main body 38 by being connected to the inner peripheral surface 38*a* at two sides in the third direction (direction that is orthogonal to the aligned direction of the sidewalls 12, 22 and the longitudinal direction of the partition wall 31).

Figure 5:
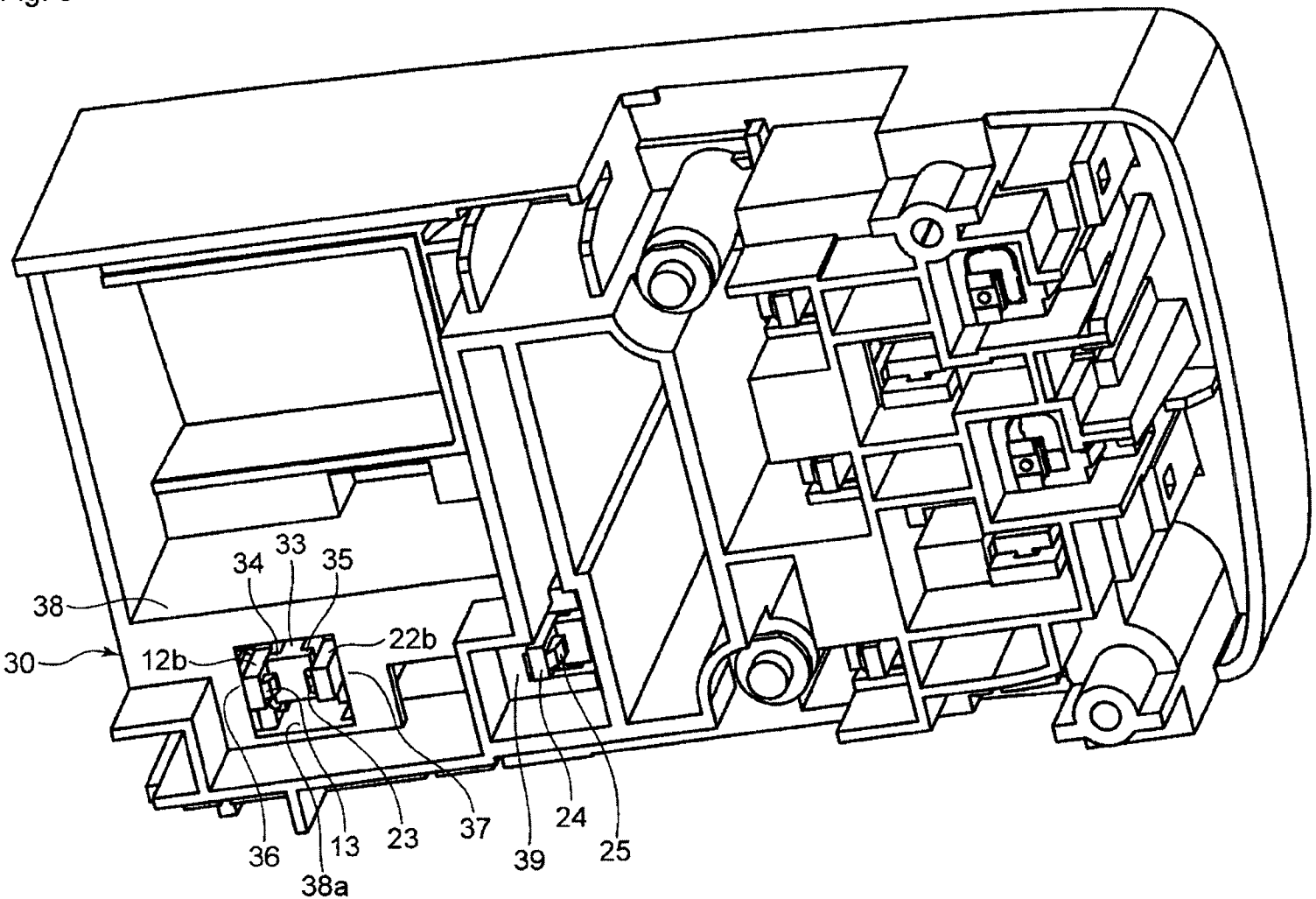
FIG. 5 is a perspective view of a state viewed from a back side of the press operation device illustrated in FIG. 1.

The elastically deformable part 33 has a shape that extends from the rear end surface of the fixed part 32 toward the rear end side and is spaced apart from the inner peripheral surface 38*a*. Specifically, as illustrated in FIGS. 5-7 and the like, the elastically deformable part 33 has a dimension in the third direction smaller than the dimension of the fixed part 32 in the same direction. The elastically deformable part 33 is connected to a substantially central portion in the third direction of the rear end surface of the fixed part 32. When an external force in the first direction acts on a rear end part of the elastically deformable part 33, the elastically deformable part 33 deflectively deforms using a boundary with the fixed part 32 as a fulcrum point in a manner allowing the rear end part to be displaced in the first direction, that is, in a direction approaching the first sidewall 12 side or in a direction approaching the second sidewall 22 side. A rear end surface of the elastically deformable part 33 is formed flat. In the present embodiment, the elastically deformable part 33 having a shape that is spaced apart from the inner peripheral surface 38*a* is described. However, the elastically deformable part 33 may also have a shape that is connected to the inner peripheral surface 38*a* as far as the elastically deformable part 33 is capable of elastic deformation using a boundary with the fixed part 32 as a fulcrum point in a manner allowing the rear end part of the elastically deformable part 33 to be displaced in the direction the first sidewall 12 side or the direction approaching the second sidewall 22 side.

The first engagement part 34 engages the first engaged part 13 when a rear end surface of the first engagement part 34 becomes in contact with an upper end surface (end surface on the upstream side in the insertion direction of the first sidewall 12) of the first engaged part 13 in a manner preventing displacement of the first engaged part 13 in a direction opposite to the insertion direction, that is, preventing the first operation member 10 from slipping out from the holding member 30. Specifically, the first engagement part 34 has a shape protruding from a rear end part of the elastically deformable part 33 toward the first sidewall 12 side. The rear end surface of the first engagement part 34, that is, the surface in contact with the front end surface of the first engaged part 13, is formed flat. The rear end surface of the first engagement part 34 and the rear end surface of the elastically deformable part 33 are on the same plane. The second engagement part 35 has a shape that is the same as the first engagement part 34 except that the second engagement part 35 protrudes from the rear end part of the elastically deformable part 33 toward the second sidewall 22 side, and thus, its explanation is omitted.

Figure 8:
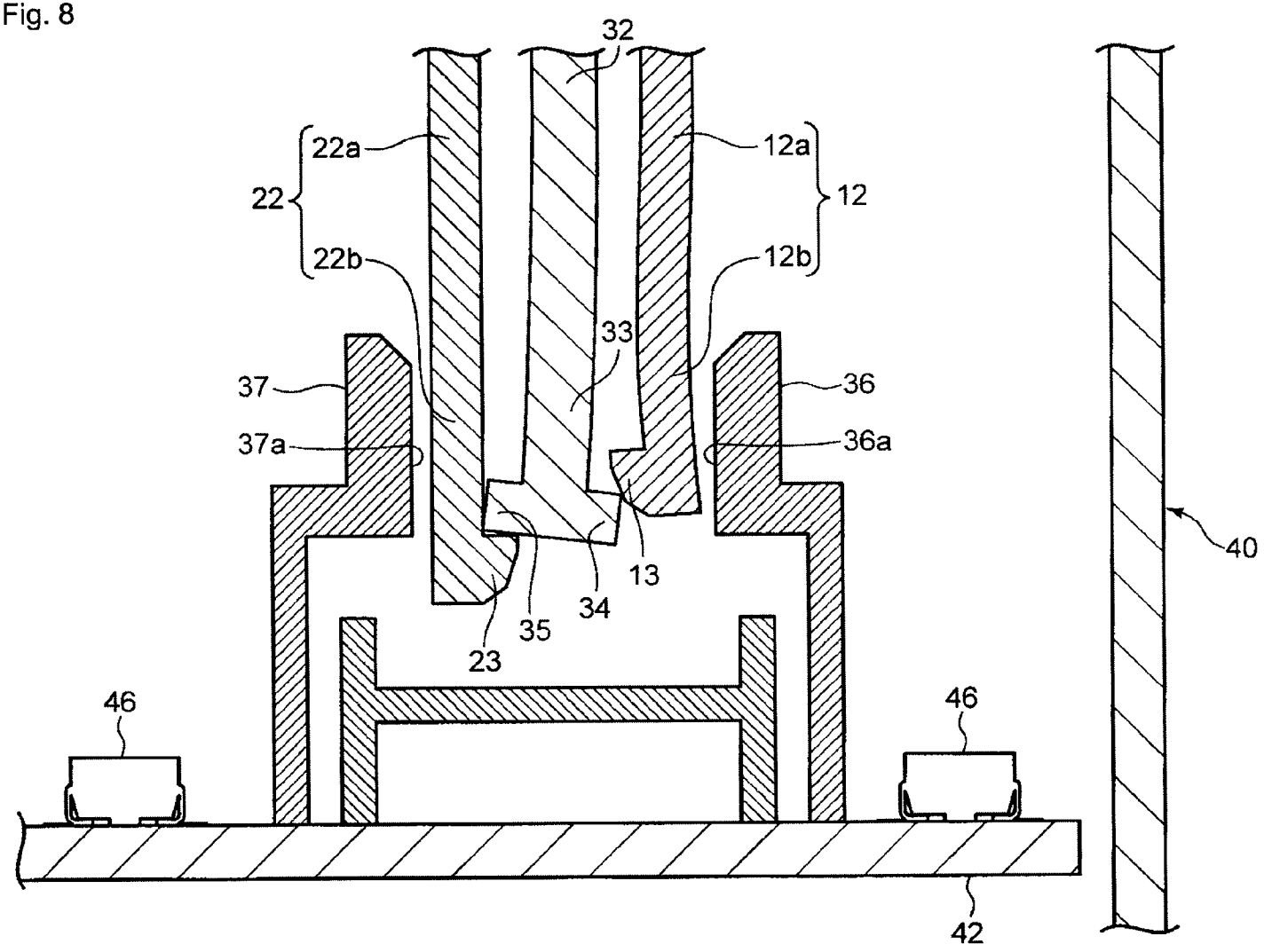
FIG. 8 is diagram explaining a state in which an elastically deformable part and a first deformable part illustrated in FIG. 3 have deformed.
Figure 9:
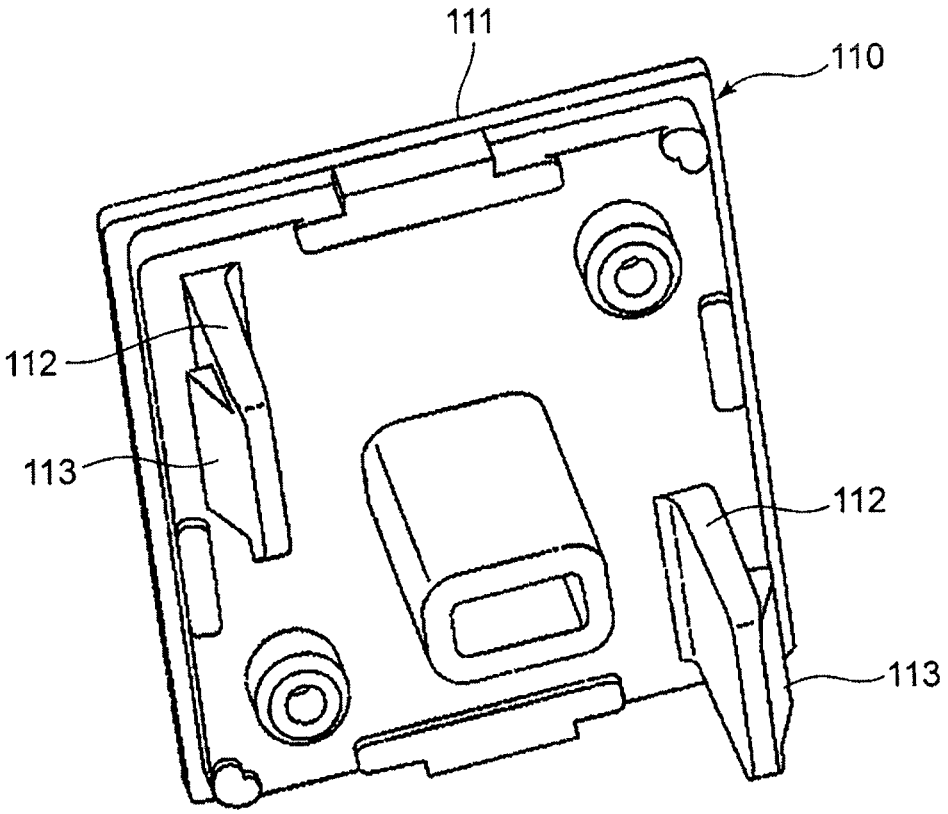
FIG. 9 is a perspective view of an operation member of a conventional press operation device described in Patent Document 1.
Figure 10:
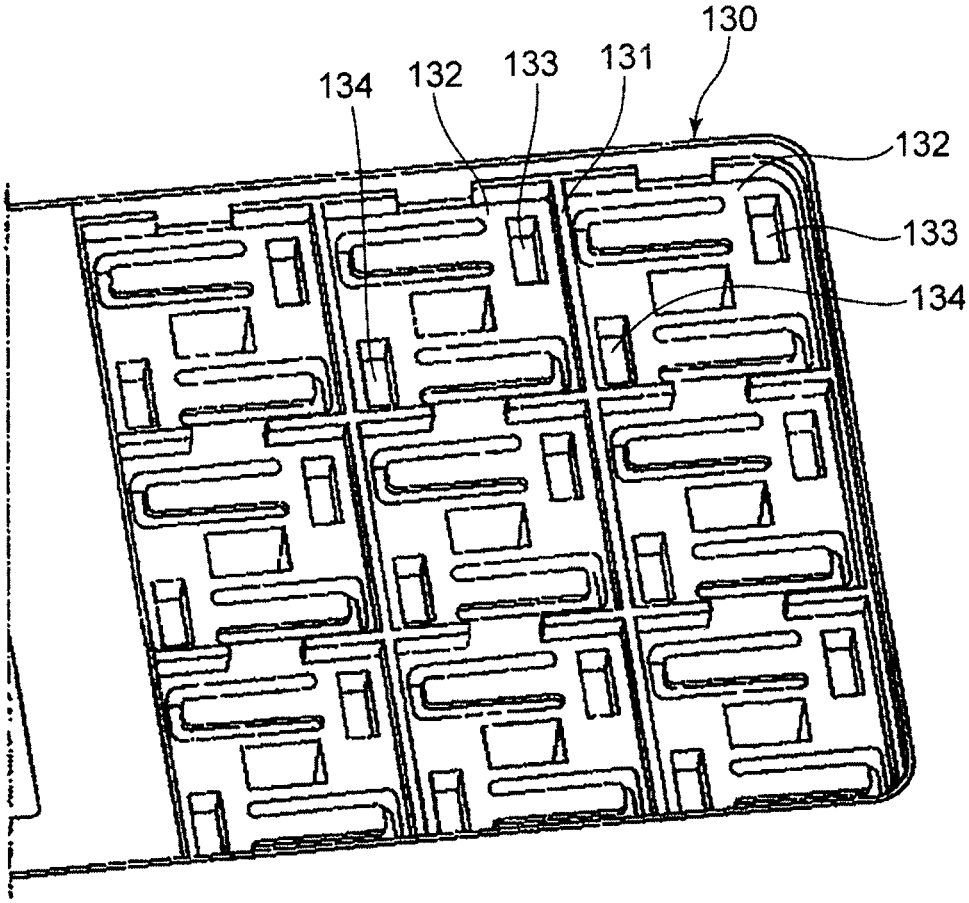
FIG. 10 is a perspective view of a holding member of the conventional press operation device described in Patent Document 1.

As illustrated in FIGS. 3, 6 and 8 and the like, the first limiting part 36 is provided on an opposite side of the partition wall 31 across the first sidewall 12. FIG. 8 illustrates a state in the middle of installation of the first operation member 10 after the second operation member 20 has been installed to holding member 30. The first limiting part 36 limits displacement of the rear end part of the first deformable part 12*b* in a direction away from the partition wall 31. Specifically, the displacement of the rear end part of the first deformable part 12*b* in the direction away from the partition wall 31 is restricted by the contact of the first deformable part 12*b* with an inner surface 36*a* of the first limiting part 36. Further, the first limiting part 36 is configured to be at a position such that a dimension between the first engagement part 34 and the inner surface 36*a* of the first limiting part 36 in a state in which an external force in the first direction is not acting on the first engagement part 34 and the elastically deformable part 33 is not elastically deformed is smaller than a first thickness dimension that is a sum of a dimension of the first sidewall 12 in the first direction and a dimension of the first engaged part 13 in the first direction.

Figure 4:
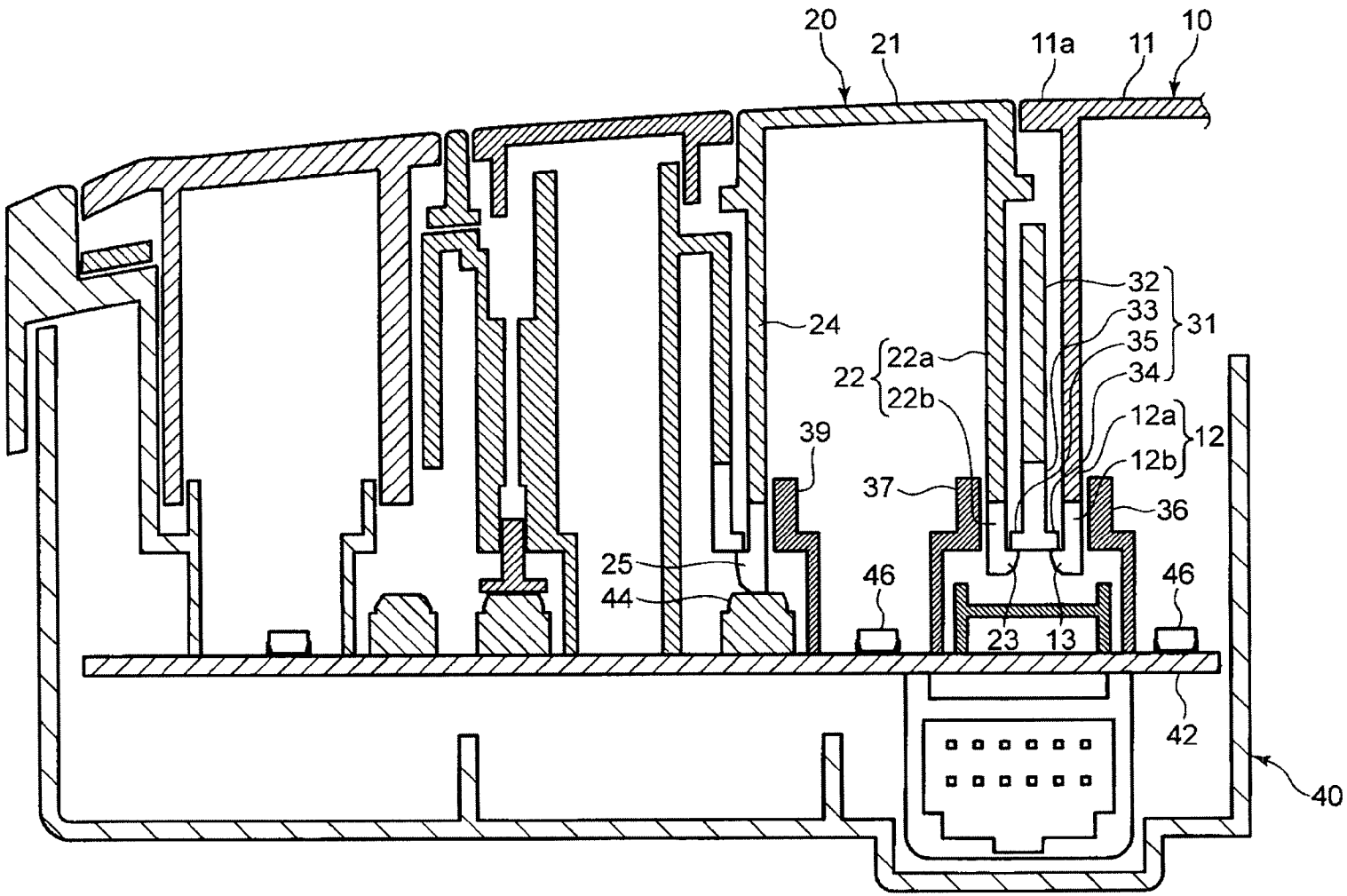
FIG. 4 is a cross-sectional view along a line IV-IV in FIG. 1.

As illustrated in FIGS. 3 and 4, the second limiting part 37 has a shape that is symmetric to that of the first limiting part 36 with respect to the partition wall 31, and thus, its explanation is omitted. Further, the third limiting part 39 has a shape that is symmetric to that of the second limiting part 37 with respect to a central axis of the second operation member 20, and thus, its explanation is omitted.

Here, when an external force such as that the first engagement part 34 pushes the rear end part of the elastically deformable part 33 toward the second engagement part 35 side is applied to the first engagement part 34, the elastically deformable part 33 elastically deforms in a manner that the first engagement part 34 is displaced in a direction away from the first limiting part 36. This allows the dimension between the first engagement part 34 and the inner surface 36*a* of the first limiting part 36 to be larger than the first thickness dimension, and thus allows the first engaged part 13 to be inserted between the first engagement part 34 and the first limiting part 36. The same applies to the second engagement part 35. That is, the elastically deformable part 33 deflectively deforms in a manner allowing the first engagement part 34 and the second engagement part 35 to be displaced in the first direction between the first limiting part 36 and the second limiting part 37.

The detection element 44 detecting a press operation of the second operation member 20 is mounted at a position that is pressed by the rear end part of the third sidewall 24 of the second operation member 20. The light source 46 for illuminating the second operated part 21 is mounted between the second limiting part 37 and the third limiting part 39. Space between the second limiting part 37 and the third limiting part 39 is configured large enough to secure an illumination range of the light source 46.

Next, an assembly process of the press operation device is explained.

First, the printed circuit board 42 is housed in the case 40. Then, the holding member 30 is housed in the case 40 in such a manner that the holding member 30 is position on a front end side of the printed circuit board 42.

Next, in the present embodiment, first, the second operation member 20 is installed to the holding member 30. Specifically, the second operation member 20 is inserted with the second engaged part 23 and the third engaged part 25 at front into the side for installing the second operation member 20 in the area surrounded by the inner peripheral surface 38*a* of the holding member main body 38. The second sidewall 22 and the third sidewall 24 behave in the same way, so here only the second sidewall 22 side is explained. When the second operation member 20 is inserted, until the second engaged part 23 becomes in contact with the second engagement part 35, a dimension between the second engagement part 35 and an inner surface 37*a* of the second limiting part 37 is smaller than a second thickness dimension (sum of the dimension of the second sidewall 22 in the first direction and the dimension of the second engaged part 23 in the first direction).

When the second engaged part 23 becomes in contact with the second engagement part 35, an external force acts on the second engagement part 35 in a direction in which the second engagement part 35 moves away from the second limiting part 37, and as a result, the elastically deformable part 33 begins to deform. Further, an external force acts on the second engaged part 23 in a direction in which the second engaged part 23 moves away from the elastically deformable part 33, and as a result, the second deformable part 22*b* begins to elastically deform. Thereafter, as the insertion of the second sidewall 22 proceeds, the second engaged part 23 and the second engagement part 35 are displaced in directions away from each other. Specifically, the second deformable part 22*b* elastically deforms until the rear end part of the second deformable part 22*b* becomes in contact with the inner surface 37*a* of the second limiting part 37, and the elastically deformable part 33 elastically deforms in a manner that the second engagement part 35 is displaced in the direction away from the second limiting part 37 until the dimension between the second engagement part 35 and the inner surface 37*a* of the second limiting part 37 becomes larger than the second thickness dimension. As a result, the dimension between the second engagement part 35 and the inner surface 37*a* of the second limiting part 37 becomes larger than the second thickness dimension. Therefore, the insertion of the second engaged part 23 between the second engagement part 35 and the second limiting part 37 is allowed. After the second engaged part 23 has passed through between the second engagement part 35 and the second limiting part 37, the elastically deformable part 33 returns to its neutral position, and the front end surface of the second engaged part 23 becomes in contact with the rear end surface of the second engagement part 35, and thereby, the second engaged part 23 is engaged by the second engagement part 35.

Next, the first operation member 10 is installed to the holding member 30. That is, the first operation member 10 is inserted with the first engaged part 13 at front into the side for installing the first operation member 10 in the area surrounded by the inner peripheral surface 38*a* of the holding member main body 38. In this case, until the first engaged part 13 becomes in contact with the first engagement part 34, a dimension between the first engagement part 34 and the inner surface 36*a* of the first limiting part 36 is smaller than the first thickness dimension (sum of the dimension of the first sidewall 12 in the first direction and the dimension of the first engaged part 13 in the first direction).

As illustrated in FIG. 8, when the first engaged part 13 becomes in contact with the first engagement part 34, an external force acts on the first engagement part 34 in a direction in which the first engagement part 34 moves away from the first limiting part 36, and as a result, the elastically deformable part 33 begins to deform. Further, an external force acts on the first engaged part 13 in a direction that the first engaged part 13 moves away from the elastically deformable part 33, and as a result, the first deformable part 12*b* begins to elastically deform. Thereafter, as the insertion of the first sidewall 12 proceeds, the first engaged part 13 and the first engagement part 34 are displaced in directions away from each other. Specifically, the first deformable part 12*b* elastically deforms until the rear end part of the first deformable part 12*b* becomes in contact with the inner surface 36*a* of the first limiting part 36, and the elastically deformable part 33 elastically deforms in a manner that the first engagement part 34 is displaced in the direction away from the first limiting part 36 until the dimension between the first engagement part 34 and the inner surface 36*a* of the first limiting part 36 becomes larger than the first thickness dimension. As a result, the dimension between the first engagement part 34 and the inner surface 36*a* of the first limiting part 36 becomes larger than the first thickness dimension. Therefore, the insertion of the first engaged part 13 between the first engagement part 34 and the first limiting part 36 is allowed. After the first engaged part 13 has passed through between the first engagement part 34 and the first limiting part 36, the elastically deformable part 33 returns to its neutral position, and the front end surface of the first engaged part 13 becomes in contact with the rear end surface of the first engagement part 34, and thereby, the first engaged part 13 is engaged by the first engagement part 34. The dimension between the elastically deformable part 33 and the second sidewall 22 may also be configured in such a manner that, when the first engaged part 13 is inserted, as a result of that the elastically deformable part 33 has elastically deformed in the manner that the first engagement part 34 is displaced in the direction away from the first limiting part 36, the second engagement part 35 becomes in contact with the second deformable part 22*b* and presses the second deformable part 22*b*, and thereby the second deformable part 22*b* elastically deforms in a manner that the rear end part of the second deformable part 22*b* is displaced in the direction approaching the second limiting part 37.

As explained above, in the press operation device of the present embodiment, the dimension between the first engagement part 34 and the first limiting part 36 in the state in which the elastically deformable part 33 is not elastically deformed is smaller than the first thickness dimension (sum of the dimension of the first sidewall 12 in the aligned direction and the dimension of the first engaged part 13 in the aligned direction). The dimension between the second engagement part 35 and the second limiting part 37 in the state in which the elastically deformable part 33 is not elastically deformed is smaller than the second thickness dimension (sum of the dimension of the second sidewall 22 in the aligned direction and the dimension of the second engaged part 23 in the aligned direction). Further, the elastically deformable part 33 is provided in the partition wall 31. When the first engagement part 34 receives an external force in the direction away from the first limiting part 36, the elastically deformable part 33 elastically deforms in such a manner that the first engagement part 34 is displaced in the direction away from the first limiting part 36 until the dimension between the first engagement part 34 and the first limiting part 36 is larger than the first thickness dimension and insertion of the first engaged part 13 into between the first engagement part 34 and the first limiting part 36 is allowed. When the second engagement part 35 receives an external force in the direction away from the second limiting part 37, the elastically deformable part 33 elastically deforms in such a manner that the second engagement part 35 is displaced in the direction away from second limiting part 37 until the dimension between the second engagement part 35 and the second limiting part 37 is larger than the second thickness dimension and the insertion of the second engaged part 23 into between the second engagement part 35 and the second limiting part 37 is allowed. Therefore, while allowing the operation members to be installed to the holding member 30, the dimensions of the portions of the holding member 30 into which the engaged parts of the operation members are inserted can be shortened.

This allows, for example, the first operation member 10 and the second operation member 20 to be prevented from simultaneously slipping out. Specifically, the sum of the dimension between the first engagement part 34 and the first limiting part 36 in the state in which the elastically deformable part 33 is not elastically deformed and the dimension between the second engagement part 35 and the second limiting part 37 in the state in which the elastically deformable part 33 is not elastically deformed is smaller than the sum of the first thickness dimension and the second thickness dimension. Therefore, after the two engaged parts are engaged by the engagement parts, even when an impact or the like is applied to the press operation device, the operation members can be prevented from simultaneously dropping out from the holding member 30.

Further, in the case where the light sources 46 for illuminating the operated parts are provided, it is possible to reduce the dimensions of the holding member 30 and the operation members in the aligned direction while securing illumination ranges of the light sources 46. Specifically, in the press operation device of the present embodiment, the dimension between the first engagement part 34 and the first limiting part 36 in the state in which the elastically deformable part 33 is not elastically deformed is shortened. Therefore, it is possible to shorten a dimension between the light source 46 and the partition wall 31 while securing an illumination range of the light source 46 for illuminating the first operated part 11. This allows the dimension of the first operation member 10 in the aligned direction to be reduced. Similarly, it is possible to shorten a dimension between the light source 46 and the partition wall 31 while securing an illumination range (dimension between the second limiting part 37 and the third limiting part 39) of the light source 46 for illuminating the second operated part 21. This allows the dimension of the second operation member 20 in the aligned direction to be reduced.

It should be noted that the embodiments disclosed herein in all aspects are for exemplary purposes only and are not to be construed as limiting of the present invention. The scope of the present invention is indicated not by the above explanation of the embodiments, but by the appended claims, and further includes all modifications equivalent to or within the spirit and scope of the appended claims.

For example, in the present embodiment, an example is explained in which the light sources 46 are provided for illuminating the operated parts. However, the light sources 46 may be omitted.

Further, in the above embodiment, an example is explained in which, as illustrated in FIG. 3, small clearances are formed between the first sidewall 12 and the first limiting part 36 and between the second sidewall 22 and the second limiting part 37 in the state in which the operation members are installed to the holding member 30. However, it is also possible that these clearances are not formed. That is, it is also possible to have such a configuration that, in the state in which the operation members are installed to the holding member 30, the first sidewall 12 and the inner surface 36*a* of the first limiting part 36 are in contact with each other and the second sidewall 22 and the inner surface 37*a* of the second limiting part 37 are in contact with each other. In this case, when the operation members are inserted into the holding member 30, only the elastically deformable part 33 deforms.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A press operation device comprising:

a first operation member having a first operated part that is press-operated;

a second operation member adjacent to the first operation member and having a second operated part that is press-operated in a same direction as a pressing direction of the first operation member; and a holding member holding the first operation member and the second operation member, the first operation member comprising:

a first sidewall extending from a back surface of the first operated part along the pressing direction; and a first engaged part protruding from a forward end portion of the first sidewall toward a second operation member side to be engaged by the holding member, the second operation member comprising:

a second sidewall extending from a back surface of the second operated part along the pressing direction; and a second engaged part protruding from a forward end portion of the second sidewall toward a first operation member side to be engaged by the holding member, the holding member comprising:

a holding member main body having an inner peripheral surface configured to allow insertion of the first sidewall and the second sidewall along a same direction as the pressing direction and surrounds the first operation member and the second operation member;

a partition wall interposed between the first sidewall and the second sidewall and separating the first operation member and the second operation member;

a first limiting part limiting displacement of the first sidewall in a direction away from the partition wall; and a second limiting part limiting displacement of the second sidewall in a direction away from the partition wall, the partition wall comprising a movable part capable of relative displacement with respect to the inner peripheral surface of the holding member main body in an aligned direction of the first sidewall and the second sidewall, the movable part comprising:

a first engagement part engaging the first engaged part so as to restrict displacement of the first engaged part in a direction opposite to an insertion direction of the first operation member by contacting the first engaged part from an upstream side in the insertion direction;

a second engagement part engaging the second engaged part so as to restrict displacement of the second engaged part in the direction opposite to the insertion direction by contacting the second engaged part from the upstream side in the insertion direction; and an elastically deformable part that elastically deforms so as to allow the first engagement part and the second engagement part to be displaced in the aligned direction, the first limiting part having a shape configured such that a dimension between the first engagement part and the first limiting part in a condition in which the elastically deformable part is not elastically deformed is smaller than a first thickness dimension that is a sum of a dimension of the first sidewall in the aligned direction and a dimension of the first engaged part in the aligned direction, the second limiting part having a shape configured such that a dimension between the second engagement part and the second limiting part in the condition in which the elastically deformable part is not elastically deformed is smaller than a second thickness dimension that is a sum of a dimension of the second sidewall in the aligned direction and a dimension of the second engaged part in the aligned direction, wherein, when the first engagement part receives an external force in a direction away from the first limiting part, the elastically deformable part elastically deforms in such a manner that the first engagement part is displaced in the direction away from the first limiting part until a dimension between the first engagement part and the first limiting part is larger than the first thickness dimension and insertion of the first engaged part between the first engagement part and the first limiting part is allowed, and when the second engagement part receives an external force in a direction away from the second limiting part, the elastically deformable part elastically deforms in such a manner that the second engagement part is displaced in the direction away from the second limiting part until a dimension between the second engagement part and the second limiting part is larger than the second thickness dimension and insertion of the second engaged part between the second engagement part and the second limiting part is allowed.

2. The press operation device according to claim 1, wherein the partition wall further comprises a fixed part fixed on the holding member main body by being connected to the inner peripheral surface of the holding member main body, wherein the movable part has a shape that extends from the fixed part along the insertion direction and is spaced apart from the inner peripheral surface, and the elastically deformable part elastically deforms in such a manner that the first engagement part and the second engagement part are displaced in the aligned direction.

3. The press operation device according to claim 1, wherein the first sidewall comprises a first deformable part that elastically deforms in a manner allowing the first engaged part to be displaced in a direction approaching the first limiting part when the first engaged part receives an external force in the direction approaching the first limiting part, the second sidewall comprises a second deformable part that elastically deforms in a manner allowing the second engaged part to be displaced in a direction approaching the second limiting part when the second engaged part receives an external force in the direction approaching the second limiting part, the first limiting part is provided at a position that allows the first engaged part to be displaced in the direction approaching the first limiting part, and the second limiting part is provided at a position that allows the second engaged part to be displaced in the direction approaching the second limiting part.

4. The press operation device according to claim 2, wherein the first sidewall comprises a first deformable part that elastically deforms in a manner allowing the first engaged part to be displaced in a direction approaching the first limiting part when the first engaged part receives an external force in the direction approaching the first limiting part, the second sidewall comprises a second deformable part that elastically deforms in a manner allowing the second engaged part to be displaced in a direction approaching the second limiting part when the second engaged part receives an external force in the direction approaching the second limiting part, the first limiting part is provided at a position that allows the first engaged part to be displaced in the direction approaching the first limiting part, and the second limiting part is provided at a position that allows the second engaged part to be displaced in the direction approaching the second limiting part.

* * * * *